US009606493B2

(12) United States Patent
Irie et al.

(10) Patent No.: US 9,606,493 B2
(45) Date of Patent: Mar. 28, 2017

(54) PUNCHING DEVICE, PAPER SHEET PROCESSING APPARATUS, AND IMAGE FORMING APPARATUS

(71) Applicants: Akiyoshi Irie, Kanagawa (JP); Kazumasa Minami, Kanagawa (JP); Takuji Nakane, Kanagawa (JP)

(72) Inventors: Akiyoshi Irie, Kanagawa (JP); Kazumasa Minami, Kanagawa (JP); Takuji Nakane, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/851,631

(22) Filed: Sep. 11, 2015

(65) Prior Publication Data

US 2016/0091856 A1 Mar. 31, 2016

(30) Foreign Application Priority Data

Sep. 29, 2014 (JP) ..... 2014-197926

(51) Int. Cl.

| | |
|---|---|
| ***G03G 15/00*** | (2006.01) |
| ***G03G 21/00*** | (2006.01) |
| ***B65H 35/04*** | (2006.01) |
| ***B65H 37/00*** | (2006.01) |
| ***B26D 7/18*** | (2006.01) |

(Continued)

(52) U.S. Cl.

CPC ..... *G03G 15/6582* (2013.01); *B26D 7/18* (2013.01); *B26F 1/0092* (2013.01); *B65H 35/04* (2013.01); *B65H 37/00* (2013.01); *B26F 1/02* (2013.01); *B26F 1/12* (2013.01)

(58) Field of Classification Search

CPC ..... G03G 15/6523; G03G 2215/00814; G03G 2215/00818; G03G 15/6582; Y10S 234/00; B26D 7/1854; B26D 2007/0018; B65H 2301/51538; B65H 2301/5152; B65H 2801/42; B65H 2301/5133; Y10T 83/2218

See application file for complete search history.

(56) References Cited

U.S. PATENT DOCUMENTS 4,641,949 A * 2/1987 Wallace ..... B65H 43/02 271/258.01
5,359,750 A * 11/1994 Le Vantine ..... G03D 15/00 15/1.51

(Continued)

FOREIGN PATENT DOCUMENTS

JP 2006088248 A * 4/2006 ..... B26D 1/08
JP 2006-136956 6/2006

(Continued)

*Primary Examiner* — Blake A Tankersley
*Assistant Examiner* — Ruben Parco, Jr.
(74) *Attorney, Agent, or Firm* — Harness, Dickey & Pierce, P.L.C.

(57) ABSTRACT

A punching device includes: a punching member opens a punch hole on a sheet material on a die plate by penetrating a die hole provided to the die plate; a discharging member discharges static electricity charged on a punching chip generated by opening of the punch hole when the punching chip is guided to fall on the discharging member arranged on a lower side of the die hole and brought into contact with the discharging member; and a pressing member that presses the punching chip on the discharging member against the discharging member.

20 Claims, 7 Drawing Sheets

(51) Int. Cl.

| | |
|---|---|
| ***B26F 1/00*** | (2006.01) |
| *B26F 1/02* | (2006.01) |
| *B26F 1/12* | (2006.01) |

(56) References Cited

U.S. PATENT DOCUMENTS

| | | | | |
|---|---|---|---|---|
| 7,735,402 | B2 | 6/2010 | Tsuji et al. | |
| 2003/0080487 | A1 | 5/2003 | Tamura et al. | |
| 2007/0295178 | A1* | 12/2007 | Tsuji | B26D 7/1845<br>83/167 |
| 2008/0236351 | A1 | 10/2008 | Hidaka et al. | |
| 2010/0329755 | A1* | 12/2010 | Obuchi | B26D 7/015<br>399/361 |
| 2013/0139708 | A1* | 6/2013 | Hotta | B26D 7/32<br>101/26 |

FOREIGN PATENT DOCUMENTS

| | | |
|---|---|---|
| JP | 2008-000852 | 1/2008 |
| JP | 4401367 | 11/2009 |

* cited by examiner

PUNCHING DEVICE, PAPER SHEET PROCESSING APPARATUS, AND IMAGE FORMING APPARATUS

CROSS-REFERENCE TO RELATED APPLICATIONS

The present application claims priority to and incorporates by reference the entire contents of Japanese Patent Application No. 2014-197926 filed in Japan on Sep. 29, 2014.

BACKGROUND OF THE INVENTION

1. Field of the Invention

The present invention relates to a punching device, a paper sheet processing apparatus, and an image forming apparatus.

2. Description of the Related Art

Conventionally, there is known a paper sheet processing apparatus that performs certain post-processing such as punching processing for opening holes, by a punching device, on a paper sheet as a sheet-type recording medium on which an image is formed by an image forming unit of an image forming apparatus.

The punching device of such a kind of paper sheet processing apparatus opens a punch hole on a punching position in the paper sheet conveyed onto a die plate on which a die hole is formed, when a cutting end of a punching pin as a punching member penetrates the paper sheet from one side to the other side and passes through the die hole. The invention described in Japanese Patent No. 4401367 is known as the punching device.

The punching device of Japanese Patent No. 4401367 includes a discharging member discharging electricity on punch chips generated by opening punch holes by contact, in the upper end opening of a punch chip storing container for storing punch chips.

However, in the punching device of Japanese Patent No. 4401367, punch chips are brought into contact with the discharging member only by the weight of the punch chips. Thus, the contact resistance of the discharging member with the punching chips is high, which prevents electricity to flow easily between the discharging member and the punching chips. As a result, static electricity charged on the punching chips has not been discharged preferably.

Therefore, it is desirable to provide a punching device, a paper sheet processing apparatus, and an image forming apparatus that are capable of preferably discharging static electricity charged on punching chips immediately after punch holes are opened.

SUMMARY OF THE INVENTION

It is an object of the present invention to at least partially solve the problems in the conventional technology.

According to an aspect of the present invention, there is provided a punching device including: a punching member opens a punch hole on a sheet material on a die plate by penetrating a die hole provided to the die plate; a discharging member discharges static electricity charged on a punching chip generated by opening of the punch hole when the punching chip is guided to fall on the discharging member arranged on a lower side of the die hole and brought into contact with the discharging member; and a pressing member that presses the punching chip on the discharging member against the discharging member.

According to another aspect of the present invention, there is provided a paper sheet processing apparatus, including a punching unit that performs punching processing on a paper sheet, wherein the punching unit includes: a punching member opens a punch hole on a sheet material on a die plate by penetrating a die hole provided to the die plate; a discharging member discharges static electricity charged on a punching chip generated by opening of the punch hole when the punching chip is guided to fall on the discharging member arranged on a lower side of the die hole and brought into contact with the discharging member; and a pressing member that presses the punching chip on the discharging member against the discharging member.

According to still another aspect of the present invention, there is provided an image forming apparatus, including: an image forming unit that forms an image on a recording paper sheet; and a recording paper sheet processing unit that performs certain processing on the recording paper sheet on which the image is formed by the image forming unit, wherein the recording paper sheet processing unit includes a punching unit, the punching unit including: a punching member opens a punch hole on a sheet material on a die plate by penetrating a die hole provided to the die plate; a discharging member discharges static electricity charged on a punching chip generated by opening of the punch hole when the punching chip is guided to fall on the discharging member arranged on a lower side of the die hole and brought into contact with the discharging member; and a pressing member that presses the punching chip on the discharging member against the discharging member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
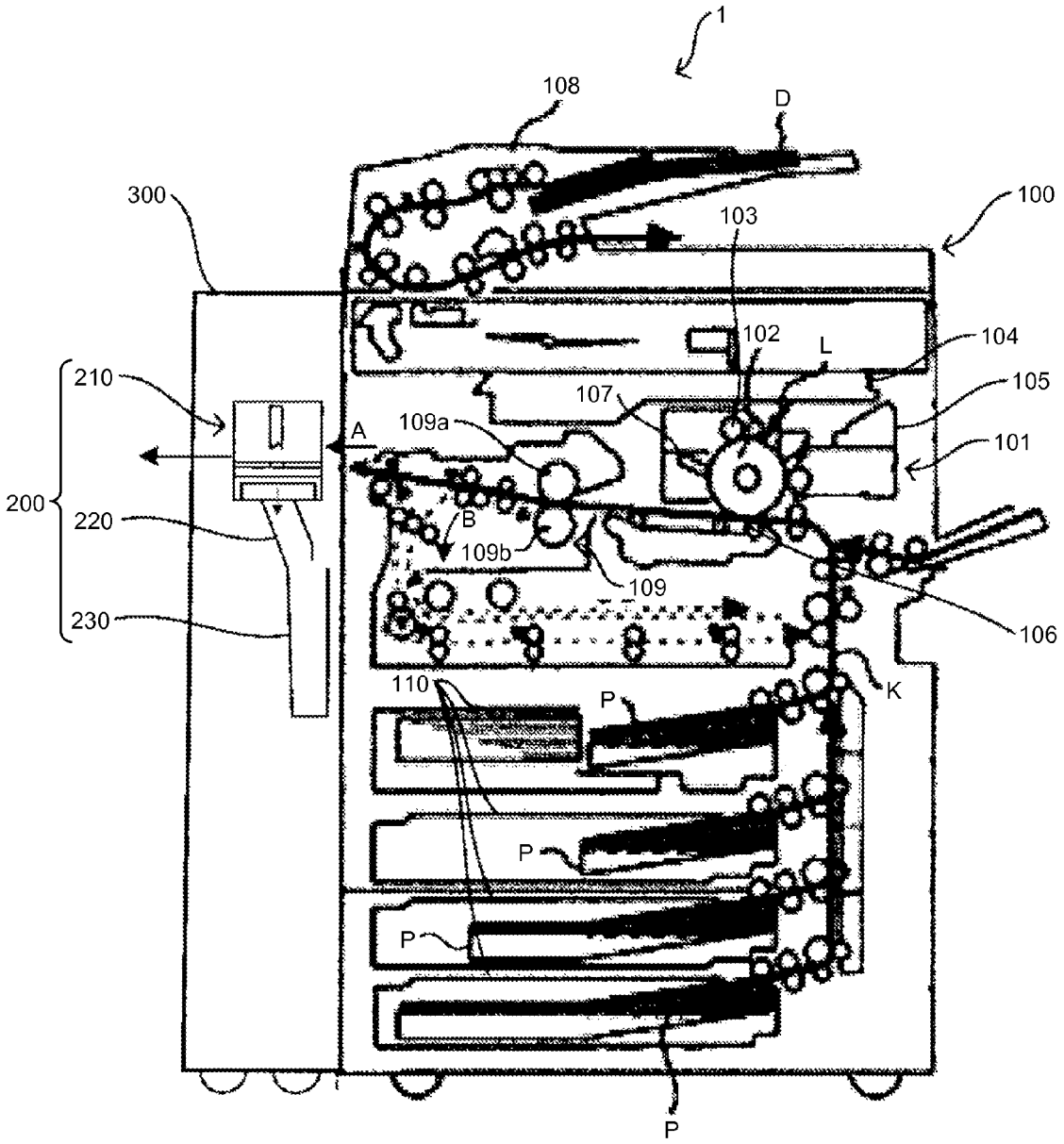
FIG. 1 is a schematic view illustrating an image forming system including a paper sheet processing apparatus provided with a punching device of an embodiment, and an image forming apparatus.

The following will describe an image forming system 1 including a paper sheet processing apparatus 300 provided with a punching device 200 according to an embodiment of the invention and an image forming apparatus 100 with reference to the enclosed drawings. FIG. 1 is a schematic view illustrating the image forming system 1.

In the image forming system 1 illustrated in FIG. 1, the image forming apparatus 100 and the paper sheet processing apparatus 300 are connected to each other so that they can perform mutual communication. In the image forming system 1, the image forming apparatus 100 forms an image on a paper sheet P as a sheet material, and the paper sheet processing apparatus 300 receives the paper sheet P from the image forming apparatus 100 and performs punching processing as post-processing on the received paper sheet P.

The image forming apparatus 100 illustrated in FIG. 1 is an example of a monochrome copying machine, and includes an image forming unit 101. The image forming unit 101 includes a photosensitive drum 102 as an image bearer, a drum charger 103, an exposure part 104, a developing part 105, a transfer part 106, a cleaning part 107, a document reading part 108, a fixing part 109, and other elements.

When the photosensitive drum 102 has received a signal instructing the start of image forming action from a control unit (not illustrated) of the image forming apparatus, the photosensitive drum 102 starts rotation in a clockwise direction in FIG. 1 and continues the rotation until the image forming action is finished. When the photosensitive drum 102 has started rotation, a high voltage is applied to the drum charger 103, and negative electric charge is charged equally on the surface of the photosensitive drum 102. The document reading part 108 optically reads out image information of a document D, and the character data or graphic data converted into a dot image from the read-out image information is transferred to the image forming apparatus 100 from the control unit (not illustrated) of the image forming apparatus as an on/off signal to the exposure part 104. Then, a part irradiated with laser light from the exposure part 104 and a part not irradiated with laser light from the exposure part 104 are formed on the surface of the photosensitive drum 102. When a part on the photosensitive drum 102 where electric charge is lowered by irradiation with laser light from the exposure part 104 has reached a position facing the developing part 105, toner charged in negative is drawn to the part on the photosensitive drum 102 where electric charge is lowered, so that a toner image is formed.

When the toner image formed on the photosensitive drum 102 has reached the transfer part 106 as a transfer unit, the toner image is transferred, by effect of a high voltage applied to the transfer part 106, onto the paper sheet P conveyed along a paper conveyance path K from any of a plurality of paper feeding trays 110. The remaining toner on the photosensitive drum 102 without being transferred even after passing a transfer position is cleaned by the cleaning part 107 so as to prepare for the following image forming action.

The paper sheet P on which the unfixed toner image is formed is passed through a transfer nip of the transfer part 106 and then transferred to the fixing part 109. The fixing part 109 includes a fixing roller 109*a* and a pressing roller 109*b* pressed against the fixing roller 109*a*. The fixing roller 109*a* and the pressing roller 109*b* are in contact with each other to form a fixing nip by which the paper sheet P is held. The fixing roller 109*a* includes therein a heat source (not illustrated) as a heating unit, and the fixing roller 109*a* is heated by heating of the heat source. The heated fixing roller 109*a* applies a heating value to the paper sheet P held by the fixing nip so as to heat the paper sheet P. The image on the paper sheet P is fixed by this heating and the influence of nip pressure.

In the case of single-side printing, the paper sheet P passed through the fixing part 109 is conveyed from the image forming apparatus 100 to the paper sheet processing apparatus 300, as illustrated by an arrow A of FIG. 1. In the case of double-side printing, the paper sheet P passed through the fixing part 109 is conveyed to a double-side conveying part, as illustrated by an arrow B, and returns to the transfer part 106 again. Then, an image formed in the same manner as the above is transferred onto the paper sheet P, and the paper sheet P is passed through the fixing part 109. The paper sheet P passed through the fixing part 109 is conveyed from the image forming apparatus 100 to the paper sheet processing apparatus 300, as illustrated by the arrow A of FIG. 1. The paper sheet processing apparatus 300 includes the punching device 200, and forms, in a punching mode, a punch hole at a certain punching position in the paper sheet P ejected from the image forming apparatus 100, when the paper sheet P passes the punching device 200. Thereafter, the paper sheet P is ejected to a paper ejection tray (not illustrated).

The paper sheet processing apparatus 300 includes a control unit (not illustrated) controlling the action of each part. The control unit is a computer including a central processing unit (CPU), a storage, a communication interface, and other components. A conveyance sensor and other devices are connected to the control unit. The control unit (CPU) drive-controls each part of the paper sheet processing apparatus 300 in accordance with a program stored in the storage. The control unit is connected to the control unit (not illustrated) of the image forming apparatus 100 so that they can perform data communication, as described above. The embodiment is not limited to the paper sheet processing apparatus including a punching device, and can be also applied to a single punching device or an image forming apparatus provided with a punching device. The image forming apparatus 100 illustrated in FIG. 1 is not limited to the monochrome copying machine, and may be a full-color copying machine.

The following will describe an example of the punching device 200 that is a characteristic part of the invention.

EMBODIMENT

Figure 2:
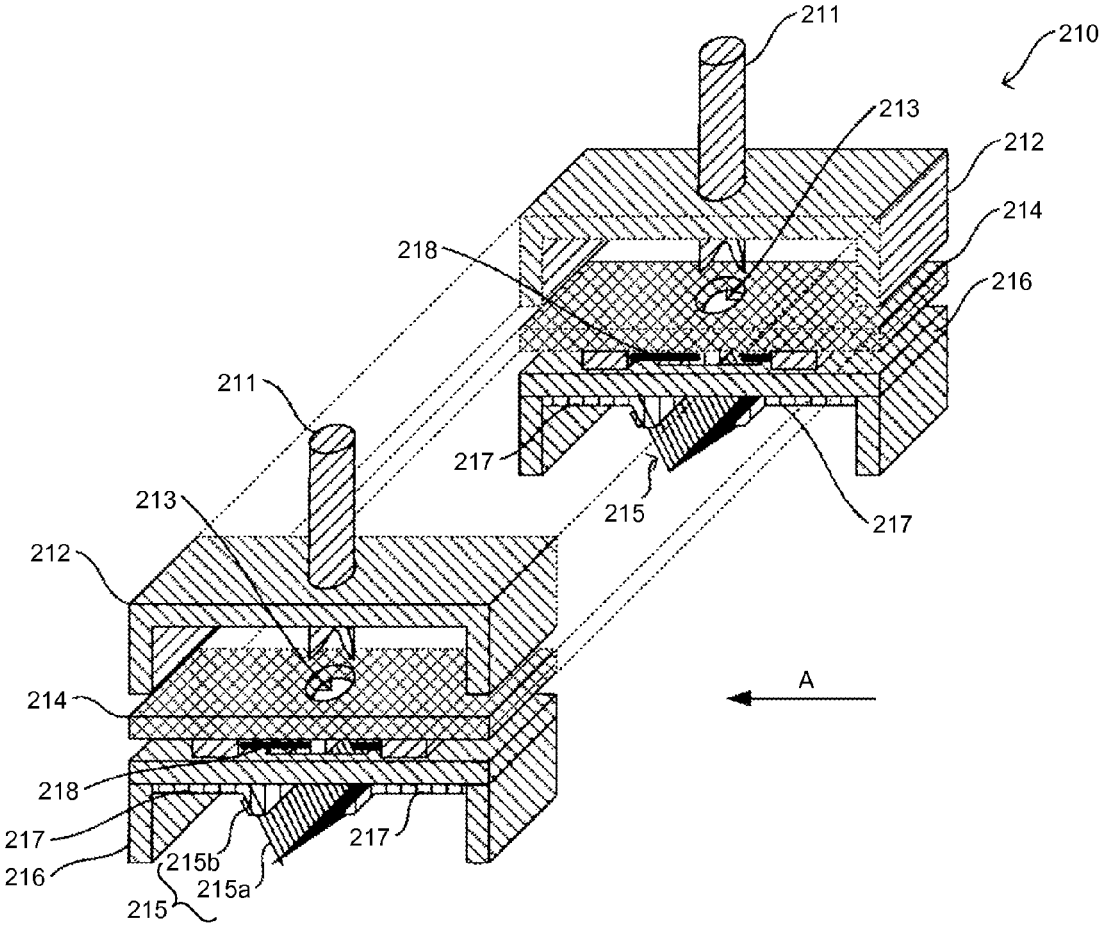
FIG. 2 is a perspective view illustrating an example of the punching device of the embodiment.
Figure 3:
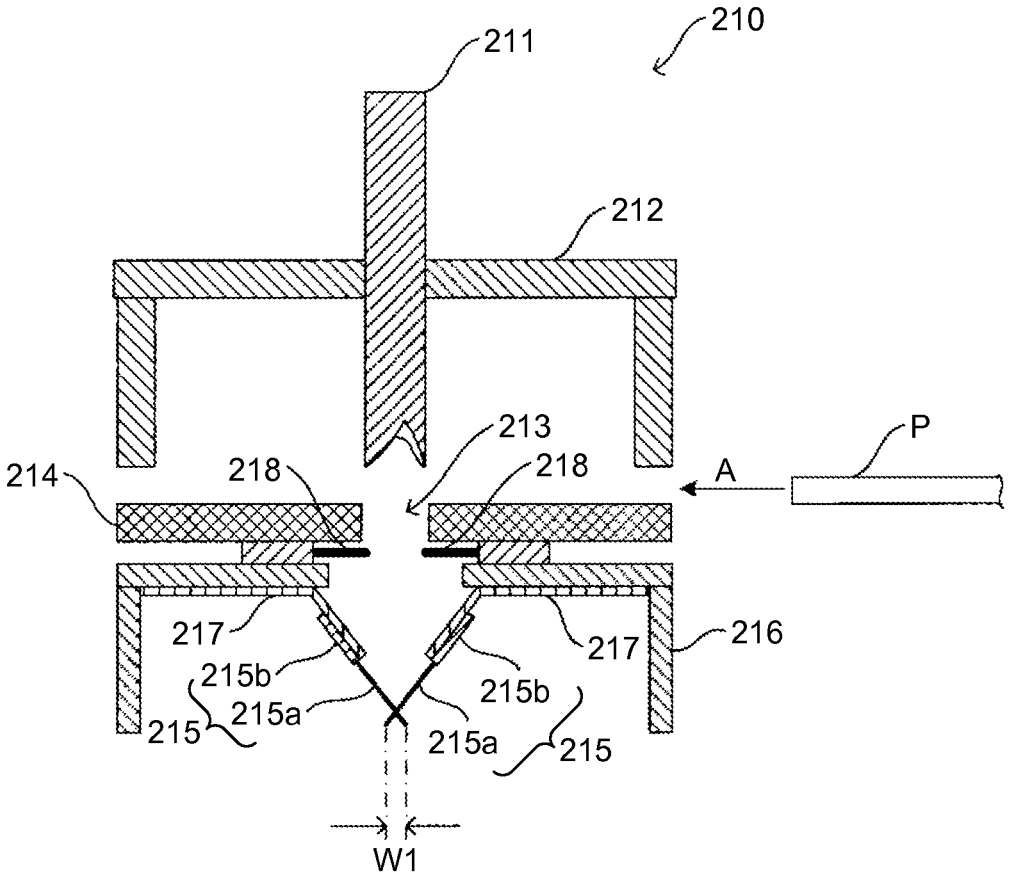
FIG. 3 is a section view of the punching device of the example, cut in a vertical direction orthogonal to a paper conveyance direction.

FIG. 2 is a perspective view illustrating an example of the punching device 200. FIG. 3 is a section view of the punching device 200 of the example, cut in a vertical direction orthogonal to a paper conveyance direction. The punching device 200 of FIG. 2 exemplifies a configuration by which punch holes are opened at two positions in a width direction of a paper sheet. However, the configuration is not limited thereto, and punch holes may be opened at three or more positions.

The punching device 200 of the example includes a punching unit 210, a punch chip ejection path 220 (refer to FIG. 1), and a punch chip storing container 230 (refer to FIG. 1). The punching unit 210 includes punching pins 211 as punching members that open holes at certain punching positions in the paper sheet P conveyed in the arrow A direction of FIG. 2 and FIG. 3, a guiding member 212 guiding reciprocation of the punching pins 211, a die plate 214 provided with die holes 213 through which the punching pins 211 pass therethrough in punching, and discharging members 215 discharging static electricity charged on the punch chips 240 generated after punching. With a driving mechanism such as a drive motor and a cam member (not illustrated), the punching pins 211 reciprocate in a punching direction orthogonal to the surface of the paper sheet P while being guided by the guiding member 212. In the example, the punching pins 211 also have a function of pressing the punch chips 240 as punching chips on the discharging members 215 against the discharging members 215 by lowering to the lowest position of the stroke when punch holes are opened. The die hole 213 is provided to the die plate 214 to face the end of the punching pin 211. The discharging member 215 is arranged on a discharging member installation members 217 provided in a supporting member 216 as a lower base. On the lower side of the discharging member 215, there is provided the punch chip storing container 230 that is detachable from the paper sheet processing apparatus 300, through the punch chip ejection path 220 guiding and ejecting the falling punch chips 240 to the punch chip storing container 230 (refer to FIG. 1).

As illustrated in FIG. 2 and FIG. 3, the discharging member installation members 217 are arranged symmetrically relative to a virtual line passing the center of the die hole 213, and one end of each discharging member installation member 217 is inclined downward with respect to a horizontal direction. When one end of the discharging member installation member 217 is inclined downward, the discharging member 215 attached along an extension direction of one end of the discharging member installation member 217 has a posture inclined downward. In this way, the posture of the punch chips 240 remaining on the discharging member 215 inclined downward is inclined vertically. Therefore, when each of the punch chips 240 passes the discharging member 215, the end of the discharging member 215 is brought into contact with both surfaces of the punch chip 240 more easily, resulting in preferable discharge of the static electricity charged on both surfaces of the punch chip 240.

Figure 4:
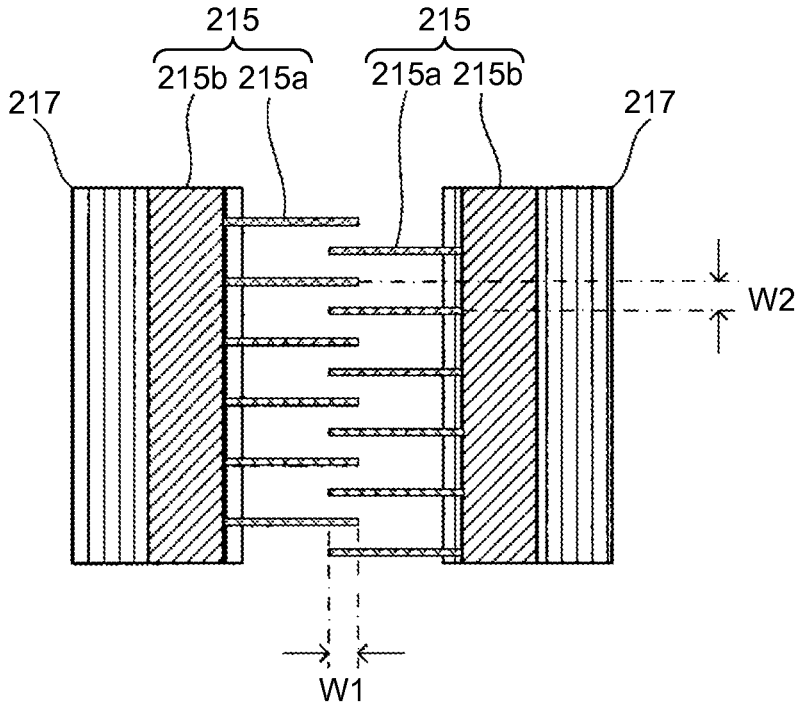
FIG. 4 is a plan view illustrating a configuration of discharging members when viewed from the lower side.
Figure 5:
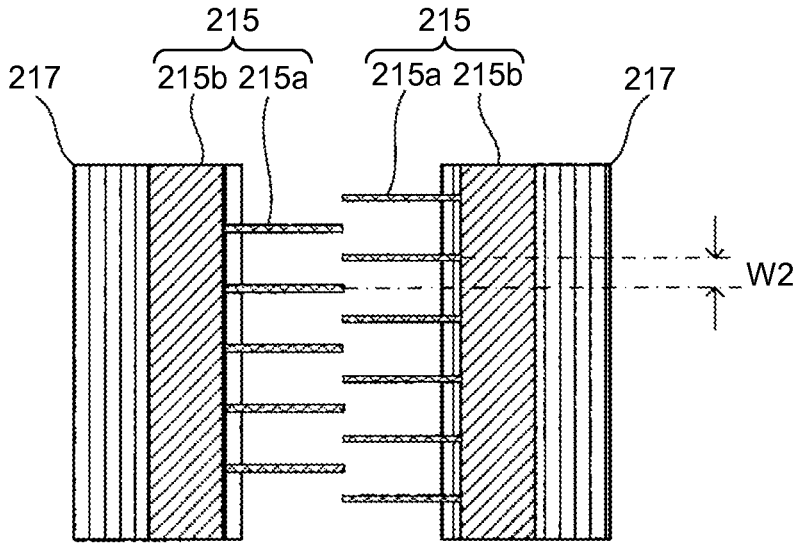
FIG. 5 is a plan view illustrating another configuration of the discharging members when viewed from the lower side.
Figure 6:
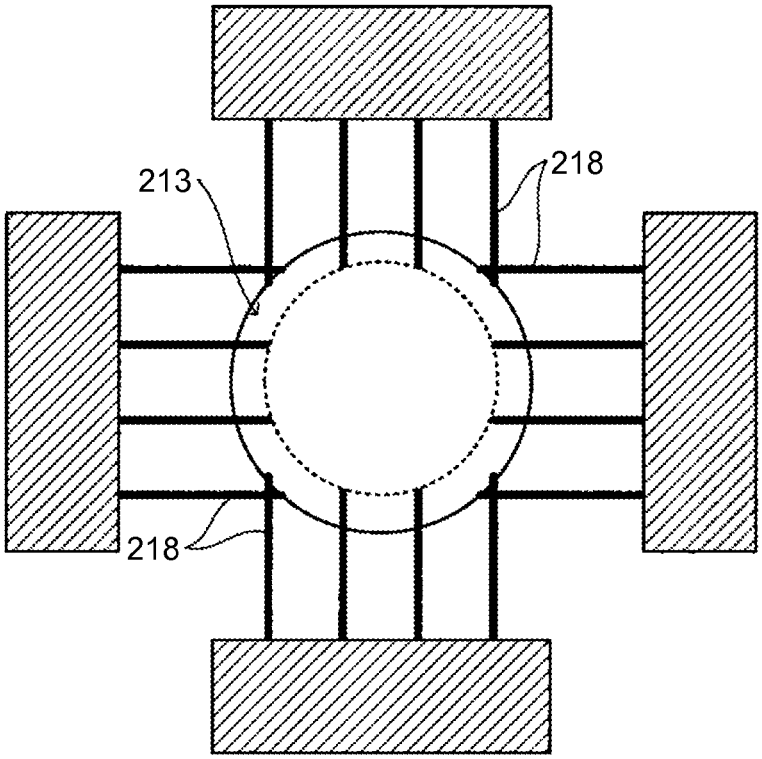
FIG. 6 is a plan view illustrating a configuration of backflow preventing members when viewed from the lower side.

As illustrated in FIG. 4, the discharging member 215 is constituted by a plurality of discharge needles 215*a* attached on a base 215*b*. The ends of the discharging members 215 cross each other when viewed from the arrangement direction of the discharge needles 215*a*, as illustrated in FIG. 3 and FIG. 4. The discharge needles 215*a* are provided so that the crossing amount W1 and a gap W2 between adjacent discharge needles 215*a* are smaller than the size (outer diameter) of the punch chip 240. This prevents the case in which the punch chip 240 falls to the punch chip storing container (not illustrated) without being discharged. As illustrated in FIG. 5, the crossing amount W1 may be substantially 0. The discharge needles 215*a* of the discharging member 215 are electrically connected to a metallic member of the apparatus housing through the base 215*b* and the discharging member installation member 217 so as to release static electricity charged on the punch chip 240 through a grounding structure. Directly under the die hole 213, there are provided backflow preventing members 218 preventing the punch chip 240 from passing through the die hole 213 in the opposite direction of the punching direction. The backflow preventing members 218 extend toward the center part of the die hole 213, as illustrated in FIG. 6. The inner diameter of an outer peripheral virtual line (dotted line of FIG. 6) of space formed by the ends of a plurality of backflow preventing members 218 is smaller than the outer diameter of the punch chip 240. In this manner, it is possible to prevent the remaining punch chips 240 from moving through space formed by the ends of the backflow preventing members 218 in the opposite direction of the punching direction and then passing through the die hole. Therefore, it is possible to prevent scattering of punch chips that become obstacles on the die plate and avoid paper conveyance jam. The backflow preventing member 218 is formed of fiber materials. Thus, it is possible to suppress abrasion of the backflow preventing member 218 and secure the durability.

Figure 7:
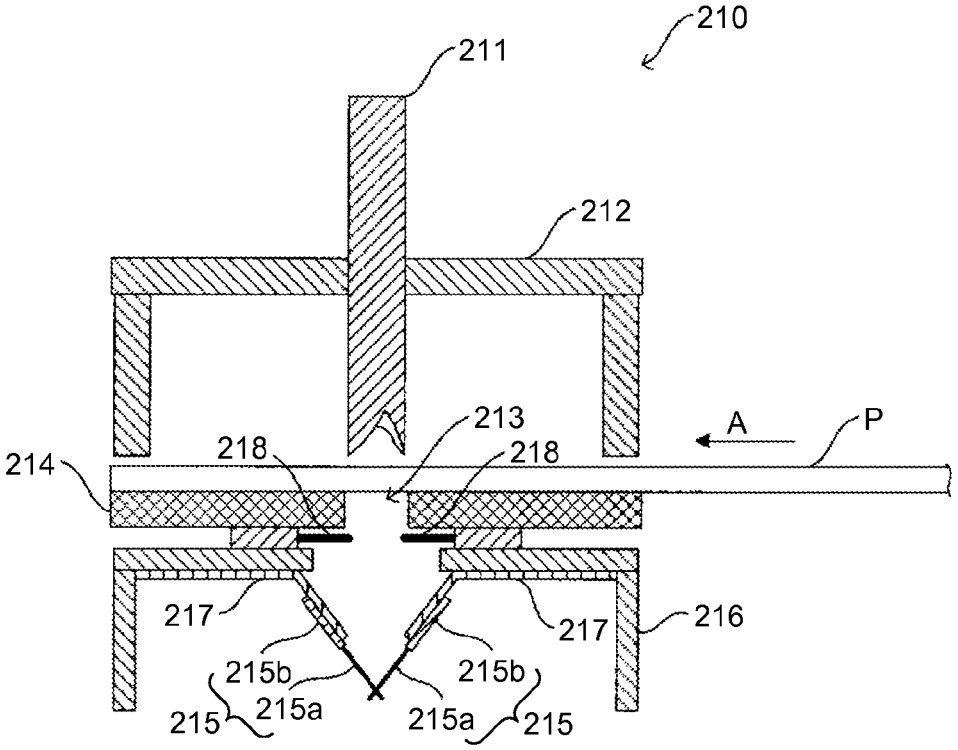
FIG. 7 is a section view illustrating punching action of the punching device of the example.
Figure 8:
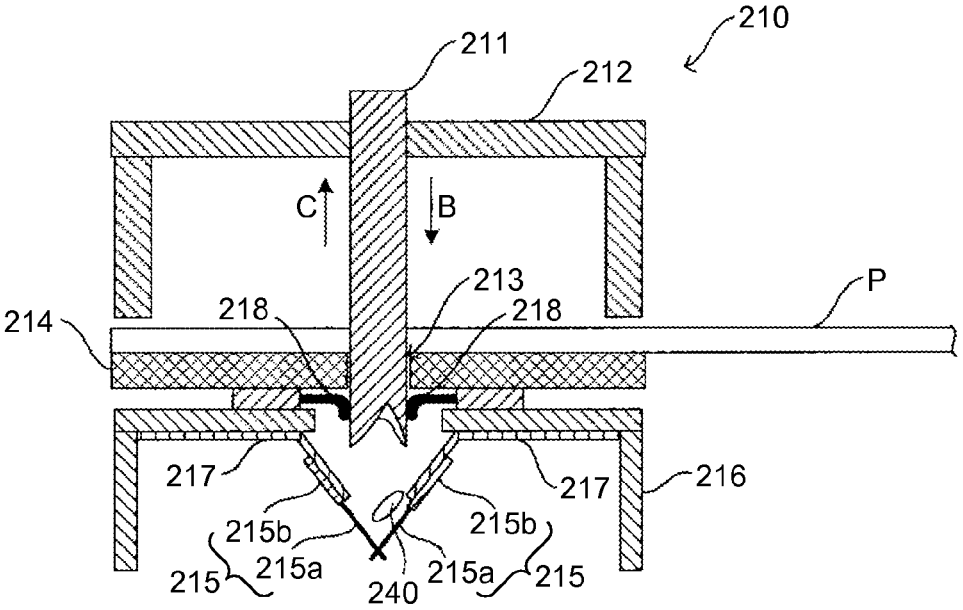
FIG. 8 is a section view illustrating punching action of the punching device of the example.
Figure 9:
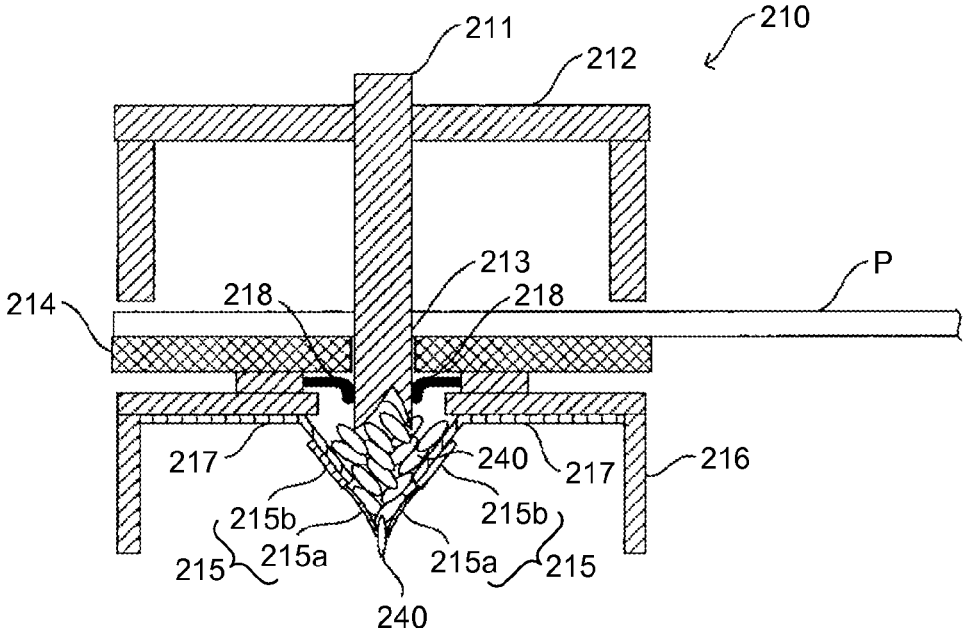
FIG. 9 is a section view illustrating punching action of the punching device of the example.

The following will describe the punching action of the punching device 200 of the example having such a configuration with reference to FIG. 7, FIG. 8, and FIG. 9.

In the punching device 200 of the example, as illustrated in FIG. 7, the paper sheet P is conveyed onto the die surface of the die plate 214 from the upstream side in the arrow A direction of FIG. 7. The paper sheet P is stopped at a position where the cutting end of the punching pin 211 and the die hole 213 substantially match each other in the punching direction. Next, as illustrated in FIG. 8, the punching pin 211 is moved in the punching direction (arrow B direction of FIG. 8) so as to form a punch hole on the paper sheet P in cooperation with the die hole 213. At that time, the entire of the cutting end of the punching pin 211 passes through the die hole 213 to a position directly under the die hole 213 that corresponds to the lowest position of the stroke of punching action. After the punch hole is formed, the punching pin 211 is moved in the opposite direction of the punching direction (arrow C direction in FIG. 8), and pulled out from the paper sheet P. The punch chip 240 generated when the punch hole is formed falls downward onto the discharging members 215 disposed directly under the die hole 213.

With repetition of punching action illustrated in FIG. 7 and FIG. 8, as shown in FIG. 9, the punch chips 240 remain in space formed by the end of the punching pin 211, which is stopped at the lowest position of the stroke of punching action after passing through the die hole 213 to form a punch hole, the discharging members 215, and the discharging member installation members 217. As a result, the total amount of electric charge of the remaining punch chips 240 is increased and then exceeds a certain amount, whereby corona discharge occurs between the punch chips 240 and the discharging members 215. In this manner, the electric charge having reverse polarity to that of the punch chips 240 is coupled with the electric charge of the punch chips 240, and thus neutralized electrically, so that the static electricity charged on the punch chips 240 can be discharged.

As illustrated in FIG. 9, when the punching pin 211 is moved in the punching direction and forms a punch hole, the cutting end of the punching pin 211 served also as a pressing member presses the remaining punch chips 240 downward, whereby the punch chips 240 are pressed against the discharging members 215. Consequently, the contact resistance of the discharging members 215 with the punch chips 240 is lowered, which facilitates the flow of electricity. As a result, the static electricity charged on the punch chips 240 in contact with the discharging members 215 flows in the discharging members 215, and further flows into the apparatus housing electrically connected to the discharging members 215 and the discharging member installation members 217. The discharged punch chips 240 are gradually pressed downward by the punching pin 211, and thus expand gaps between the ends of the discharging members 215. The punch chips 240 sequentially fall downward through such gaps to be stored in the punch chip storing container 230 through the punch chip ejection path 220.

As a result of intensive research, the inventors have found that the static electricity occurs strongly when the punching pin 211 passes through the paper sheet with toner on only one side thereof from the surface side with toner and the toner and the punching pin 211 are rubbed each other. In addition, the inventors have found that the static electricity occurs strongly also when the punching pin 211 passes through the paper sheet with toner on both sides thereof and the toner and the punching pin 211 are rubbed each other.

The static electricity potential is substantially same regardless of whether the toner with which the punching pin 211 is brought into contact exists on only one side of the paper sheet or on both sides of the paper sheet. Consequently, it has been found that when the toner exists on both sides, the surface side with toner rubbed with the punching pin 211 is charged more strongly. It can be considered that this is because the toner is formed of resin materials and such toner is rubbed with the punching pin, thereby generating static electricity. As illustrated in FIG. 9, the ends of the discharging members 215 hold both surfaces of the punch chips 240 as in the example described above, whereby the ends of the discharging members 215 are pressed against both surfaces of the punch chips 240. Thus, the contact resistance of the discharging members 215 with both surfaces of the punch chips 240 is lowered, which facilitates the flow of static electricity charged on at least one side of the punch chips 240 and allows effective discharge on at least one surface of the punch chips 240.

The pressing member is not limited to the punching pin 211 as in the example described above, and may be any member as long as it presses the punch chips 240 remaining on the discharging members 215 against the discharging members 215.

MODIFICATION

Figure 10:
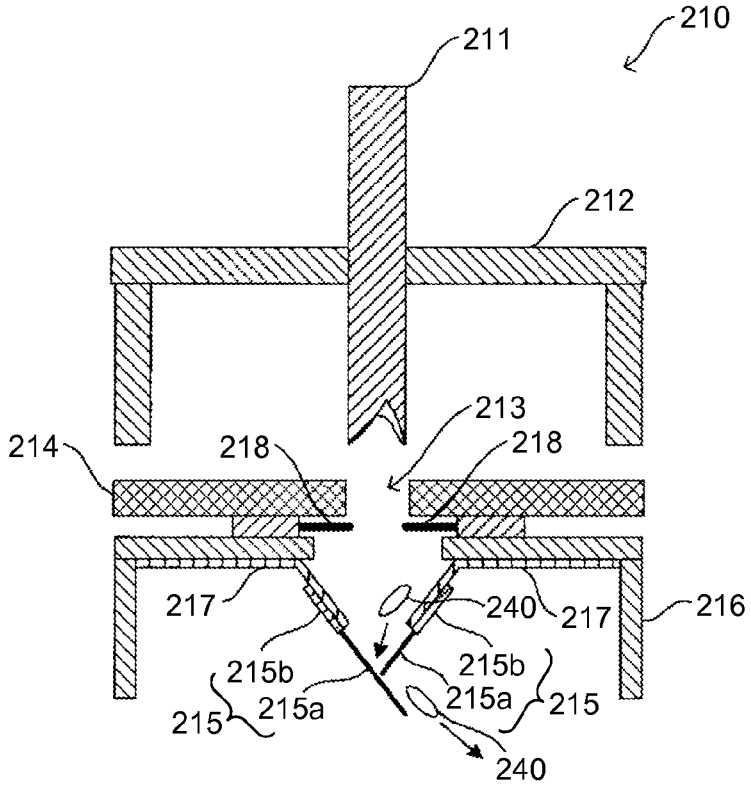
FIG. 10 is a section view of a punching device of a modification, cut in a vertical direction orthogonal to a paper conveyance direction.

Next, one modification of the punching device of the above-described embodiment will be described. FIG. 10 is a section view of the punching device 200 of a modification, cut in a vertical direction orthogonal to a paper conveyance direction. As illustrated in FIG. 10, in the punching device 200 of the modification, the discharge needle 215*a* of one of two discharging members 215 facing each other is longer than the discharge needle 215*a* of the other discharging member 215. The ends of two discharging members have a certain gap therebetween when viewed from the arrangement direction. The punching chip 240 falling onto the discharge needle 215*a* of the other discharging member 215 that is shorter than the discharge needle 215*a* of one discharging member 215 is subjected to discharge on the front surface. Thereafter, the punch chip 240 moves along the inclination direction of the discharge needle 215*a* of the other discharging member 215. Next, the punch chip 240 is passed the gap between the ends of two discharging members to the discharge needle 215*a* of one discharging member 215, and is subjected to discharge on the back surface. The punch chip 240 is guided to move along the inclination direction of one discharging member 215 and fall toward the extension direction of such a moving direction. For example, with a full-state detection sensor detecting the full-state of a container by an accumulation height of punch chips in the punch chip storing container, when punch chips stored in the punch chip storing container are accumulated unevenly at a certain position, the full-state detection sensor may wrongly detect the full-state once the accumulation height of the position at which the punch chips are accumulated unevenly has reached a detection position of the full-state detection sensor although the container is not filled. In addition, when the punch chips stored in the punch chip storing container are accumulated unevenly at a certain position, the storage amount of the punch chip storing container is reduced. According to the modification, the extension direction of the discharge needle 215*a* of one discharging member 215 that is longer than the discharge needle 215*a* of the other discharging member 215 is set to a target falling direction. As a result, the punching chips can fall to the direction with which the punch chips 240 are not stored unevenly in the punch chip storing container 230. In this manner, it is possible to suppress the case in which the punch chips are stored unevenly in the punch chip storing container, thereby preventing full-state detection errors and increasing the storage amount of the punch chip storing container.

Some examples have been described above. The invention exerts the characteristic effects in each of the following forms.

Form A

A punching device in which a punching member such as the punching pin 211 opens a punch hole on a sheet material on a die plate 214 by penetrating a die hole 213 provided to the die plate 214, a discharging member 215 discharges static electricity charged on a punching chip such as the punch chip 240 generated by opening of the punch hole when the punching chip is guided to fall on the discharging member 215 arranged on the lower side of the die hole and brought into contact with the discharging member 215, the punching device includes a pressing member that presses the punching chip on the discharging member against the discharging member.

In this manner, the punching chips on the discharging members are pressed against the discharging members by the pressing member, whereby the contact pressure of the discharging members with the punching chips is increased, and the contact resistance of the discharging members is decreased, as described in the above embodiment. This facilitates the flow of static electricity charged on the punching chips in the discharging members. Then, the static electricity charged on the punching chips can be discharged preferably.

Form B

In Form A, the pressing member is a punching member such as the punching pin 211. In this manner, the punching member reciprocates through the die hole in the direction orthogonal to the die plate, as described in the above example of the above embodiment. The discharging members are disposed at positions directly under the die hole on the downstream side of the falling direction of the punching chips so that the end of the punching member can press the punching chips against the discharging members when the punching member is moved downward to open a punch hole on a sheet material. In this manner, a discharging of the punching chips charged with static electricity can be performed immediately after the punching chips are generated. Therefore, it is possible to prevent the conventional case in which the punching chips charged with static electricity are attached on a wall surface of the punch chip ejection path provided on the downstream side of the punching direction.

Form C

In Form A or Form B, space for retaining punching chips is formed between the end of the punching member and the discharging members. In this manner, a relatively large amount of punching chips can be retained in the space formed between the end of the punching member and the discharging members, as described in the above example of the above embodiment. The total amount of electric charge of remaining punching chips is increased and then exceeds a certain amount, whereby corona discharge occurs. As a result, the electric charge having reverse polarity to that of the punching chips and the electric charge of the punching chips are coupled to each other, so as to be neutralized electrically. In this way, besides the discharge performed by pressing punching chips against the discharging members, the discharge by corona discharge occurs, thereby improving the discharge performance.

Form D

In Form A to Form C, the discharging member includes a plurality of discharging members, and the ends of the discharging members 215 face each other. In this manner, when the punching chip is passed between the ends of the discharging members, both surfaces of the punching chip are brought into contact with the ends of the discharging members, as described in the above example of the above embodiment. Thus, the static electricity charged on at least one surface of the punching chips can be discharged preferably.

Form E

In Form A to Form D, the discharging member 215 includes a plurality of discharge needles 215*a*, and the discharge needles are arranged with intervals smaller than a punching chip. In this manner, when the punching chip is passed between the discharge needles, the punching chip is easily brought into contact with the discharge needles, whereby the punching chips can be discharged securely, as described in the above example of the above embodiment.

Form F

In Form D or Form E, the needle ends of the discharge needles 215*a* arranged to form the discharging members disposed to face each other cross each other when viewed from the arrangement direction of the discharge needles 215*a*. In this manner, when the punching chip is passed between the needle ends of the facing discharge needles, both surfaces of the punching chip are pressed against the crossing part of the discharge needles, as described in the above example of the above embodiment. The punching chips are strongly pressed against the discharging members so that the crossing amount of the crossing part of the discharge needles is decreased gradually and the gaps between the needle ends of the discharge needles are expanded. As a result, the contact pressure of the discharging members with the punching chips is significantly increased, and the contact resistance of the discharging members is significantly decreased, which facilitates the flow of static electricity charged on the punching chips in the discharging members. Thus, the static electricity charged on at least one surface of the punching chips can be discharged preferably.

Form G

In Form A to Form F, the discharging members are inclined relative to the punching direction. In this manner, the posture of the punching chips becomes vertical, and both surfaces of the punching chips are easily brought into contact with the discharging members, as described in the above example of the above embodiment. Thus, the static electricity charged on at least one surface of the punching chips can be discharged preferably.

Form H

In Form A to Form G, one of the discharging members that are disposed to face each other is provided to be longer than the other discharging member, and the inclination direction of one discharging member is set in accordance with the falling direction of punching chips. In this manner, the falling direction of punching chips can be controlled, which suppresses the case in which the punching chips are stored unevenly in the punch chip storing container for storing punching chips, as described in the above modification of the above embodiment. Therefore, it is possible to prevent full-state detection errors and increase the storage amount of the punch chip storing container.

Form I

In Form A to Form H, the backflow preventing members 218 restricting the movement of punching chips in the opposite direction of the accumulation direction of the punching chips on the discharging members are arranged directly under the die hole. In this manner, the backflow preventing members are arranged directly under the die hole, which prevents the punching chips remaining on the discharging members from passing through the die hole in the opposite direction of the punching direction, as described in the example of the above embodiment. Therefore, it is possible to prevent scattering of punching chips that become obstacles on the die plate after passing through the die hole and avoid paper conveyance jam.

Form J

In Form I, the ends of the backflow preventing members extend toward the center part of the die hole. In this manner, it is possible to securely prevent the punching chips from passing through the die hole, as described in the above Modification 1 of the above embodiment.

Form K

In Form I or Form J, the backflow preventing members 218 are formed of a fiber material. In this manner, it is possible to suppress abrasion of the backflow preventing member and secure the durability, as described in the example of the above embodiment.

Form L

In the paper sheet processing apparatus 300 including a punching unit that performs punching processing on a paper sheet, the punching device 200 of Form A to Form K is used as the punching unit. In this manner, it is possible to preferably discharge static electricity charged on punching chips generated in punching processing of the paper sheet processing apparatus, as described in the above embodiment.

Form M

In the image forming apparatus 100 including an image forming unit that forms an image on a recording paper sheet and a recording paper sheet processing unit that performs certain processing on the recording paper sheet on which an image is formed by the image forming unit, the paper sheet processing apparatus 300 of Form L is used as the recording paper sheet processing unit. In this manner, it is possible to preferably discharge static electricity charged on punching chips generated when the punching processing is performed on the recording paper sheet on which the image is formed by the image forming apparatus.

The present embodiments exert the characteristic effect of preferably discharging static electricity charged on punching chips immediately after punch holes are opened.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A punching device comprising:

a punching member to open a punch hole on a sheet material on a die plate by penetrating a die hole provided to the die plate; and at least two discharging members, on a relatively lower side of the die hole, to discharge static electricity charged on a punching chip, generated by the opening of the punch hole, upon the punching chip falling on and contacting at least one of the discharging members, each of the at least two discharging members including a plurality of discharge needles at least slightly downwardly extending in a falling direction of the punching chip, at least a partial overlap between the discharge needles of one of the at least two discharging members and the discharge needles of another of the at least two discharging members existing nearly perpendicular to the falling direction of the punching chip above a discharge space, the discharge needles of one of the at least two discharge members further being intermixed with discharge needles of the another of the at least two discharging members along a direction nearly perpendicular to the falling direction.

2. The punching device according to claim 1, wherein the punching member is further configured to press the punching chip against the at least one of the at least two discharging members.

3. The punching device according to claim 1, wherein space for retaining the punching chip is formed between an end of the punching member and the discharging member.

4. The punching device according to claim 1, wherein the discharge needles are arranged at intervals, each of the intervals being relatively smaller than a diameter of the punching chip.

5. The punching device according to claim 1, wherein the at least two discharging members are inclined downward with respect to a punching direction.

6. The punching device according to claim 1, wherein lengths of the needles of the at least two discharging members extending in a falling direction of the punching chip are set such that one of the at least two discharging members, disposed to face another of the at least two discharge member, are relatively longer than needles of the another discharging member, and wherein at least a slight downward inclination direction of the one of the at least two discharging members is set in accordance with a falling direction of the punching chip.

7. The punching device according to claim 1, further comprising:

a backflow preventing member, configured to restrict movement of the punching chip to an opposite direction of an accumulation direction of the punching chip on the discharging member, arranged directly under the die hole.

8. The punching device according to claim 7, wherein an end of the backflow preventing member extends toward a center part of the die hole.

9. The punching device according to claim 7, wherein the backflow preventing member is formed of a fiber material.

10. A paper sheet processing apparatus, comprising:

a punching unit to perform punching processing on a paper sheet, the punching unit including, a punching member to open a punch hole on a sheet material on a die plate by penetrating a die hole provided to the die plate; and at least two discharging members, on a relatively lower side of the die hole, to discharge static electricity charged on a punching chip, generated by the opening of the punch hole, upon the punching chip falling on and contacting at least one of the discharging members, each of the at least two discharging members including a plurality of discharge needles at least slightly downwardly extending in a falling direction of the punching chip, at least a partial overlap between the discharge needles of one of the at least two discharging members and the discharge needles of another of the at least two discharging members existing nearly perpendicular to the falling direction of the punching chip above a discharge space, the discharge needles of one of the at least two discharge members further being intermixed with discharge needles of the another of the at least two discharging members along a direction nearly perpendicular to the falling direction.

11. An image forming apparatus, comprising:

an image forming unit to form an image on a recording paper sheet; and a recording paper sheet processing unit to perform certain processing on the recording paper sheet on which the image is formed by the image forming unit, wherein the recording paper sheet processing unit includes a punching unit, the punching unit including a punching member to open a punch hole on a sheet material on a die plate by penetrating a die hole provided to the die plate; and at least two discharging members, on a relatively lower side of the die hole, to discharge static electricity charged on a punching chip, generated by the opening of the punch hole, upon the punching chip falling on and contacting at least one of the discharging members, each of the at least two discharging members including a plurality of discharge needles at least slightly downwardly extending in a falling direction of the punching chip, at least a partial overlap between the discharge needles of one of the at least two discharging members and the discharge needles of another of the at least two discharging members existing nearly perpendicular to the falling direction of the punching chip above a discharge space, the discharge needles of one of the at least two discharge members further being intermixed with discharge needles of the another of the at least two discharging members along a direction nearly perpendicular to the falling direction.

12. The punching unit according to claim 1, wherein the at least partial overlap of the discharge needles is relatively smaller than a diameter of the punching chip.

13. The paper sheet processing apparatus according to claim 10, wherein the at least partial overlap of the discharge needles is relatively smaller than a diameter of the punching chip.

14. The paper sheet processing apparatus according to claim 10, wherein the punching member is further configured to press the punching chip against the at least one of the at least two discharging members.

15. The paper sheet processing apparatus according to claim 10, wherein lengths of the needles of the at least two discharging members extending in a falling direction of the punching chip are set such that one of the at least two discharging members, disposed to face another of the at least two discharge members, are relatively longer than needles of the another discharging member, and wherein at least a slight downward inclination direction of the one of the at least two discharging members is set in accordance with a falling direction of the punching chip.

16. The paper sheet processing apparatus according to claim 10, wherein the punching unit further comprises:

a backflow preventing member, configured to restrict movement of the punching chip to an opposite direction of an accumulation direction of the punching chip on the discharging member, arranged directly under the die hole.

17. The image forming apparatus according to claim 11, wherein the at least partial overlap of the discharge needles is relatively smaller than a diameter of the punching chip.

18. The image forming apparatus according to claim 11, wherein the punching member is further configured to press the punching chip against the at least one of the at least two discharging members.

19. The image forming apparatus according to claim 11, wherein lengths of the needles of the at least two discharging members extending in a falling direction of the punching chip are set such that one of the at least two discharging members, disposed to face another of the at least two discharge members, are relatively longer than needles of the another discharging member, and wherein at least a slight downward inclination direction of the one of the at least two discharging members is set in accordance with a falling direction of the punching chip.

20. The image forming apparatus according to claim 11, wherein the punching unit further comprises:

a backflow preventing member, configured to restrict movement of the punching chip to an opposite direction of an accumulation direction of the punching chip on the discharging member, arranged directly under the die hole.

* * * * *